US006709050B2

(12) United States Patent
Huang

(10) Patent No.: US 6,709,050 B2
(45) Date of Patent: Mar. 23, 2004

(54) SLIDE RAIL-TYPE METAL FOLDABLE CHAIR

(76) Inventor: Tsung-Chieh Huang, No. 1 Ta Yo 2 St. Ta Fa Industrial District., Kaohsiung Hsien (TW)

( * ) Notice: Subject to any disclaimer, the term of this patent is extended or adjusted under 35 U.S.C. 154(b) by 0 days.

(21) Appl. No.: 10/175,632

(22) Filed: Jun. 19, 2002

(65) Prior Publication Data

US 2003/0234562 A1 Dec. 25, 2003

(51) Int. Cl.[7] ..... A47C 4/00

(52) U.S. Cl. ..... 297/57; 297/58; 297/59; 297/447.2

(58) Field of Search ..... 297/57, 56, 440.16, 297/59, 58, 55, 447.2

(56) References Cited

U.S. PATENT DOCUMENTS 1,568,244 A * 1/1926 Rosenkranz ..... 297/56
1,910,539 A * 5/1933 Hambrook et al. ..... 248/432
1,949,492 A * 3/1934 Schermerhorn ..... 297/57
2,664,943 A * 1/1954 Clarin ..... 297/41
2,982,339 A * 5/1961 Clarin ..... 297/56
4,415,201 A * 11/1983 Wang ..... 297/57
5,681,078 A * 10/1997 Chen ..... 297/58

* cited by examiner

*Primary Examiner*—Anthony D. Barfield
*Assistant Examiner*—Stephanie Harris
(74) *Attorney, Agent, or Firm*—Pro-Techtor International Services

(57) ABSTRACT

A folding chair with a front chair leg pivotally connected to a rear chair leg at a pivot point. The front leg has an elongated slide with a slide washer. A slide magazine having a U-shaped cross-section is movably disposed in the slide of the front chair leg. A bottom end of the slide magazine includes a fitting hole to receive a rear pivot shaft of the seat. The rear chair leg is pivotally connected to the front chair leg at the pivot point. The pivoting sections of the seat and front and rear chair legs are all hidden, with only the pivot point exposed. The chair is light and easy to operate.

6 Claims, 8 Drawing Sheets

SLIDE RAIL-TYPE METAL FOLDABLE CHAIR

BACKGROUND OF THE INVENTION

The present invention is related to a slide rail-type metal foldable chair. The front chair leg is:

A conventional slide rail-type foldable chair is made of wooden material. This is the wooden material can be easily milled and processed. Such slide rail-type folding mechanism makes it easy to fold and unfold the chair. When operated, a user's hand is protected from being clamped by the front and rear chair legs in the pivot corner. However, the wooden chair has heavy weight and the pattern of the wooden chair is limited.

It has been tried by manufacturers to apply slide rail-type folding mechanism to metal foldable chair. However, it is troublesome and time-consuming to mill the metal tube (generally iron tube or stainless steel tube) with slide rail. Therefore, up to now, the slide rail-type folding mechanism still cannot be fully applied to the non-wooden foldable chairs.

SUMMARY OF THE INVENTION

It is therefore a primary object of the present invention to provide a slide rail-type metal foldable chair in which the front and rear chair legs are preferably made of rustproof and light aluminum alloy or other metal. The foldable chair of the present invention has light weight and can be smoothly operated. The foldable chair can be folded into a plane state without clamping the user's hand. The number of the pivoted sections of the seat and the front and rear chair legs exposed to outer side is minimized.

The present invention can be best understood through the following description and accompanying drawings wherein:

DETAILED DESCRIPTION OF THE PREFERRED EMBODIMENT

Figure 1:
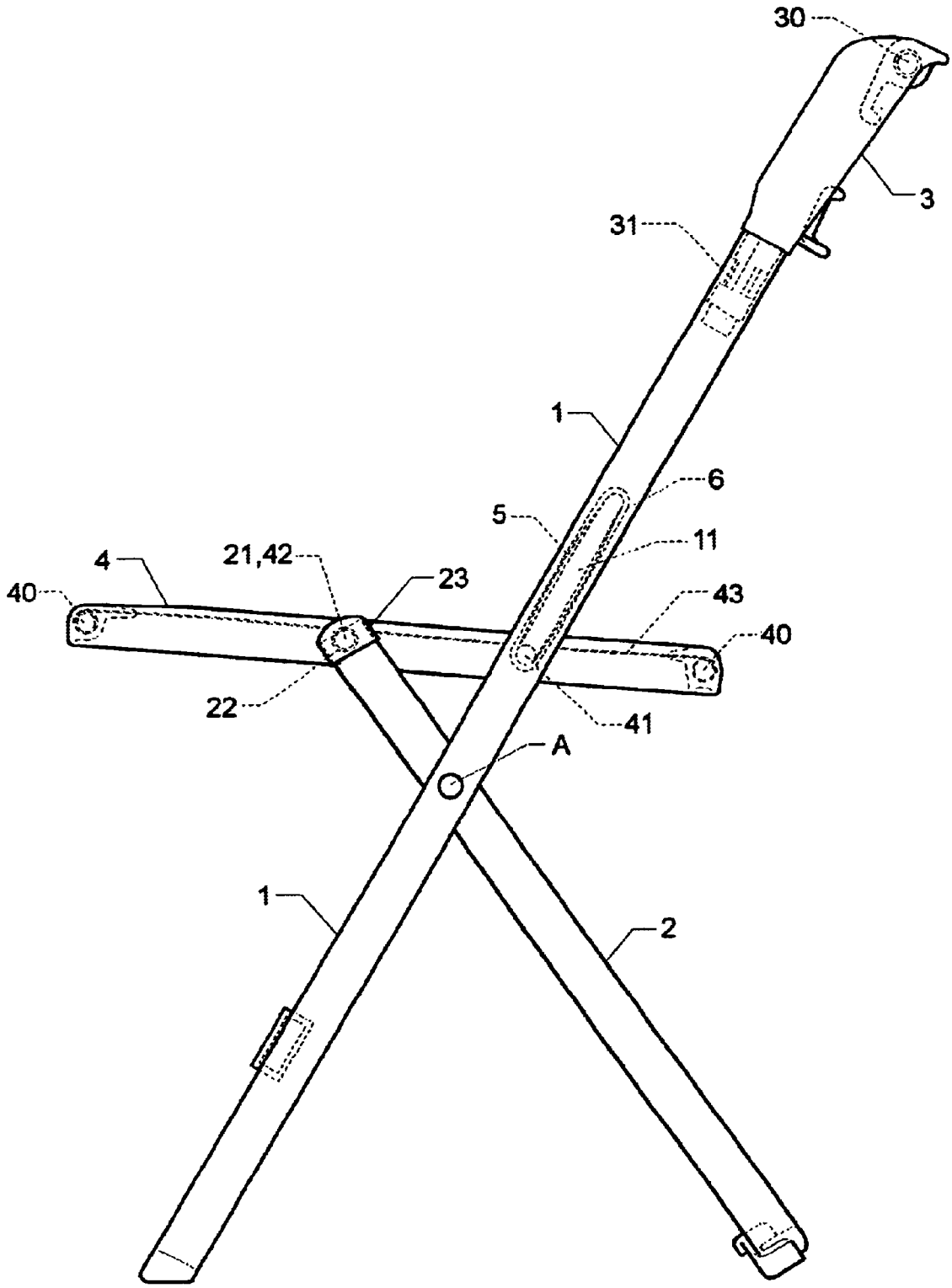
FIG. 1 is a side view of the present invention.
Figure 2:
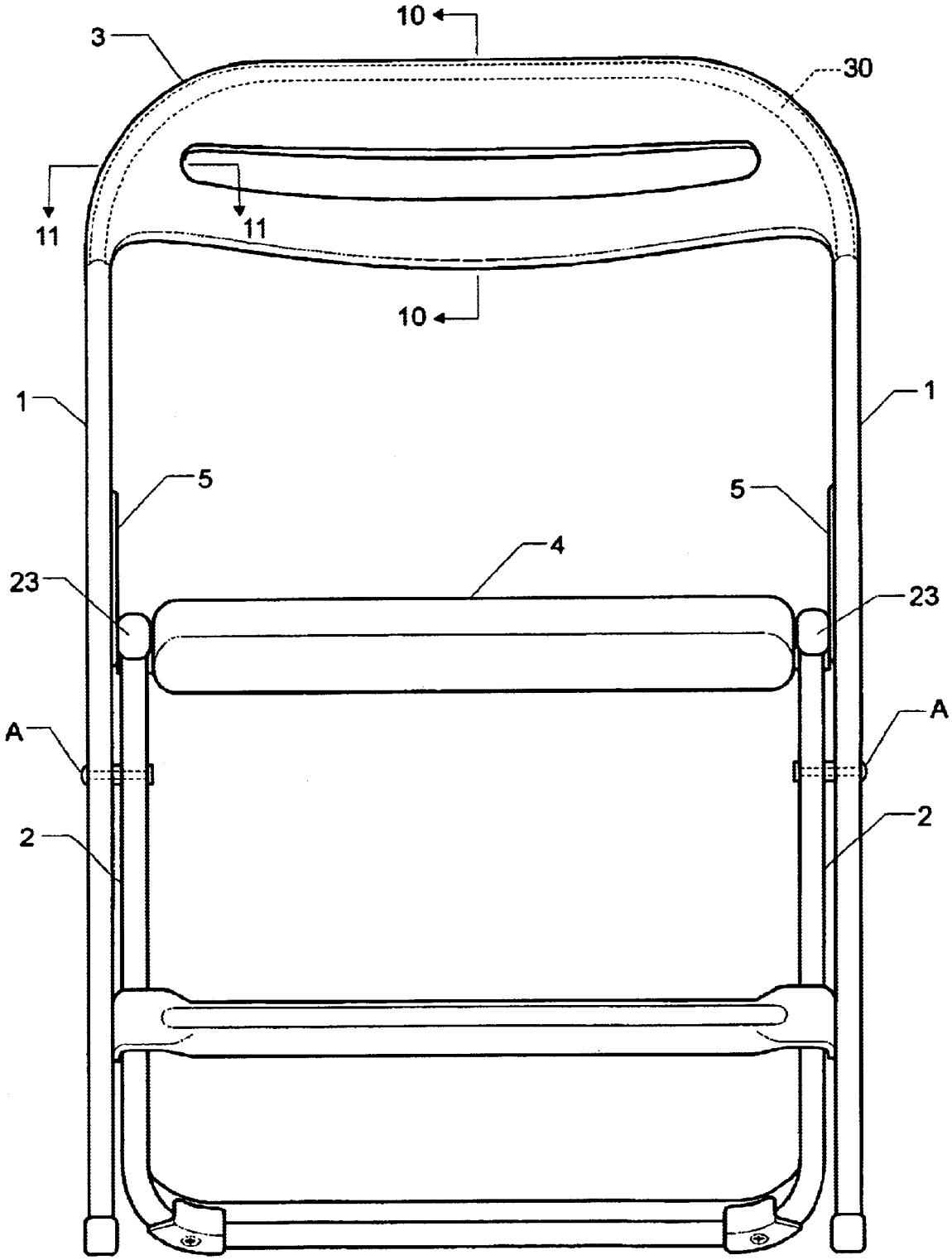
FIG. 2 is a front view of the present invention.
Figure 3:
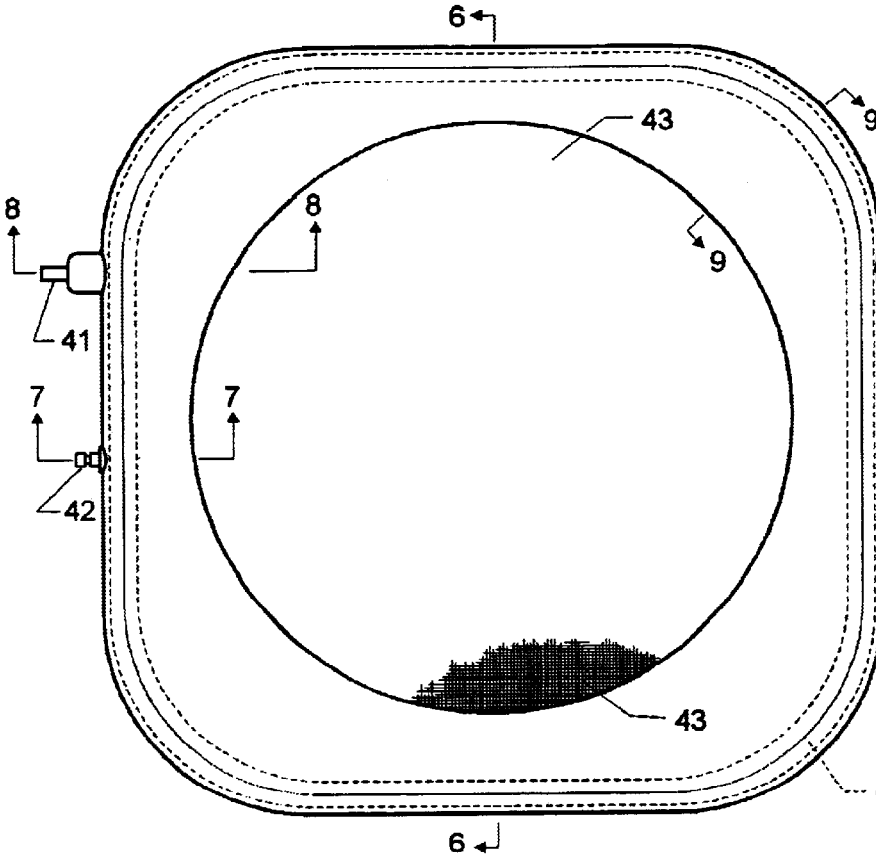
FIG. 3 is a top view of the seat of the present invention.
Figure 4:
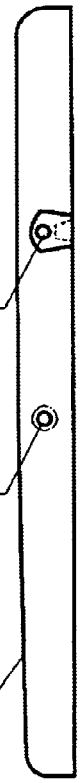
FIG. 4 is a right view according to FIG. 3.
Figure 5:
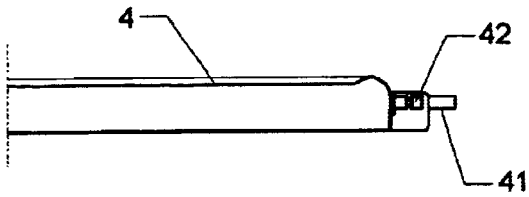
FIG. 5 is a front view of the seat of the present invention, showing the pivot shafts thereof.
Figure 6:
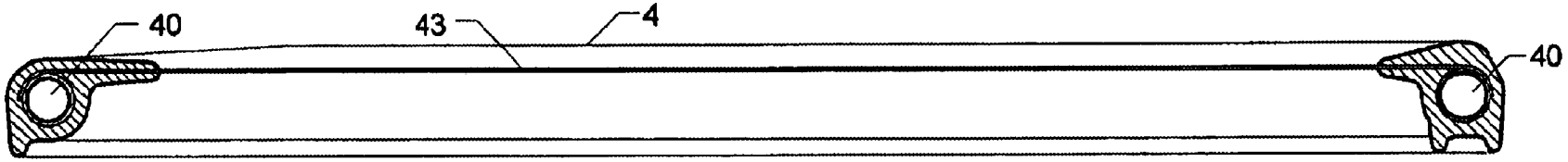
FIG. 6 is a sectional view taken along line 6—6 of FIG. 3.
Figure 9:
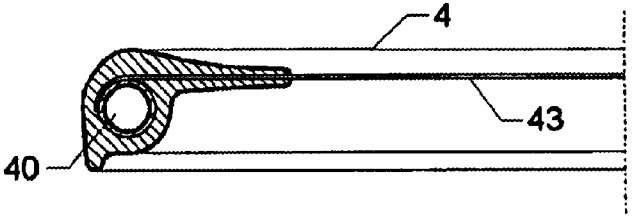
FIG. 9 is a sectional view taken along line 9—9 of FIG. 3.
Figure 7:
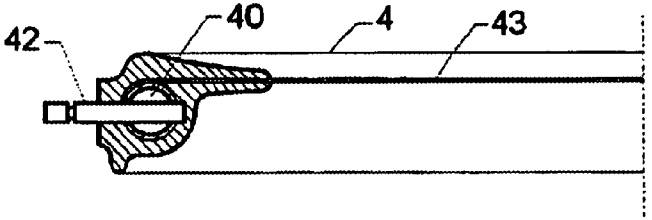
FIG. 7 is a sectional view taken along line 7—7 of FIG. 3.
Figure 8:
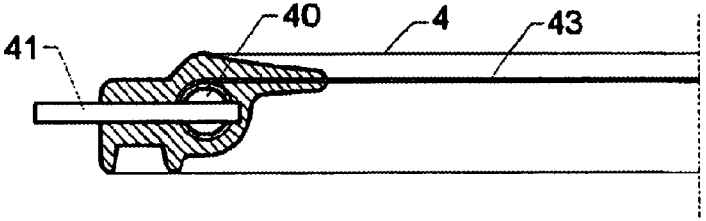
FIG. 8 is a sectional view taken along line 8—8 of FIG. 3.

Please refer to FIGS. 1 and 2. The present invention includes a front chair leg 1, a rear chair leg 2, a back 3 and a seat 4.

Figure 11:
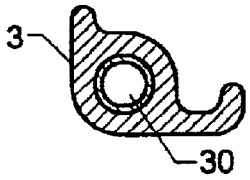
FIG. 11 is a sectional view taken along line 11—11 of FIG. 2, showing the back of the present invention.
Figure 10:
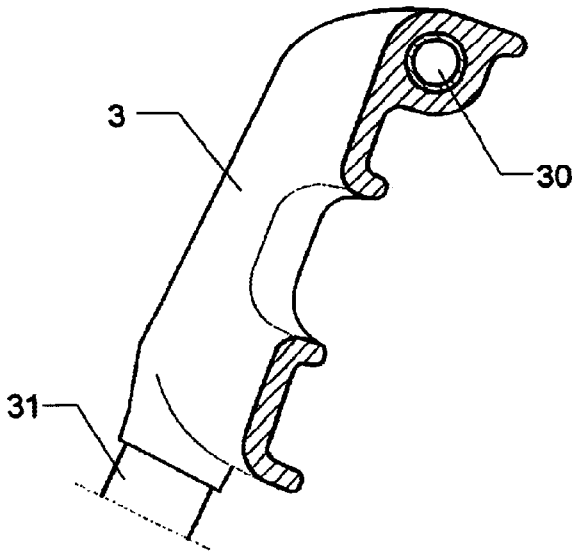
FIG. 10 is a sectional view taken along line 10—10 of FIG. 2, showing the back of the present invention.
Figure 15:
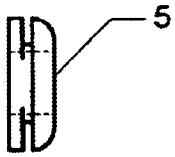
FIG. 15 is a right view according to FIG. 13.
Figure 14:
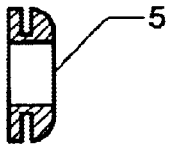
FIG. 14 is a sectional view taken along line 14—14 of FIG. 13.
Figure 13:
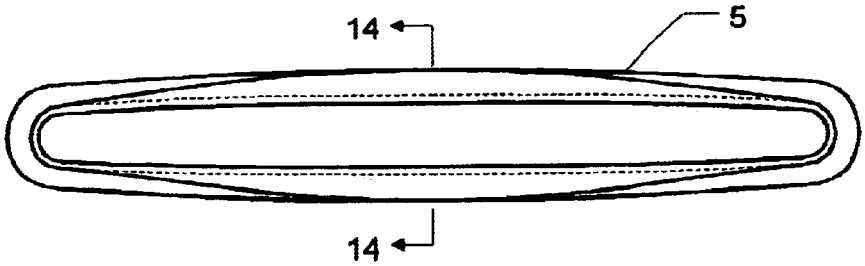
FIG. 13 is a top view according to FIG. 12.
Figure 12:
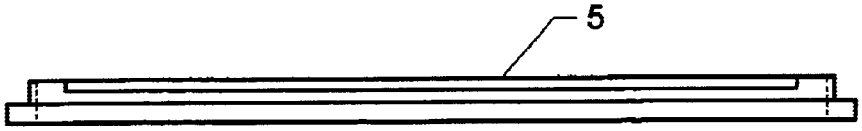
FIG. 12 shows the slide rail washer of the present invention.

The front and rear chair legs 1, 2 are tubular bodies made of aluminum alloy (or other metal). The front chair leg 1 is pivotally connected with the rear chair leg 2 at pivot point A. The inner side of the front chair leg 1 is formed with an elongated slide rail 11 above the pivot point A. The slide rail passes through the inner wall of the front chair leg. A slide rail washer 5 (as shown in FIGS. 12 to 15) is laid on the opening of the slide rail 11. The slide rail washer 5 has a substantially I-shaped cross-section. When formed, two sides of the slide rail washer 5 are slightly outward curved. When laid on the opening of the slide rail 11, the slide rail washer has a set outward expanding supporting and fixing elasticity so as not to detach from the opening. The back 3 is inserted in upper side of the front chair leg 1. The back 3 encloses therein a metal tube (as shown in FIGS. 2 and 10 to 11). The back is composed of a U-shaped metal tube 30 coated with a plastic back. Two sides of the metal tube 30 has downward extending insertion legs 31 for fixedly inserting in the top openings of two sides of the front chair leg 1. After the slide magazine 6 is placed into the front chair leg 1 and the front chair leg 1 is completely assembled with the rear pivot shaft 41 of the seat 4, the back 3 is assembled with the front chair leg 1.

Figure 17:
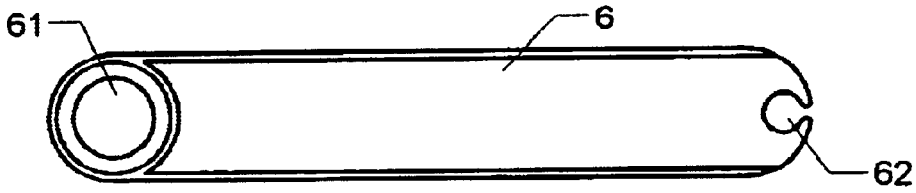
FIG. 17 is a top view according to FIG. 15.
Figure 16:
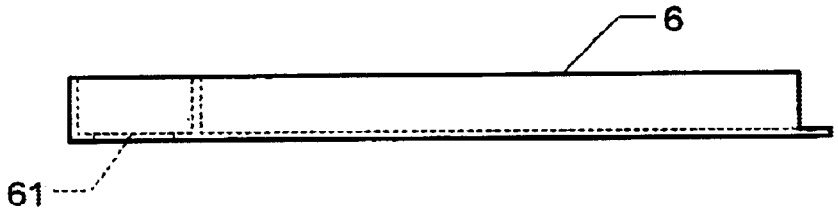
FIG. 16 shows the slide magazine of the present invention.
Figure 18:
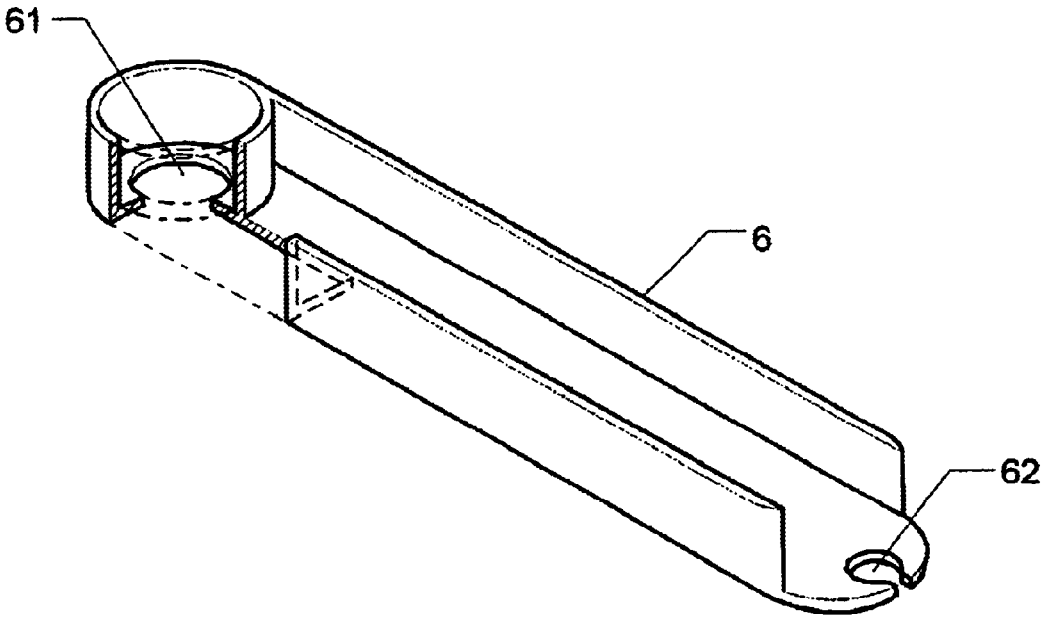
FIG. 18 is a partial sectional view of the slide magazine.
Figure 19:
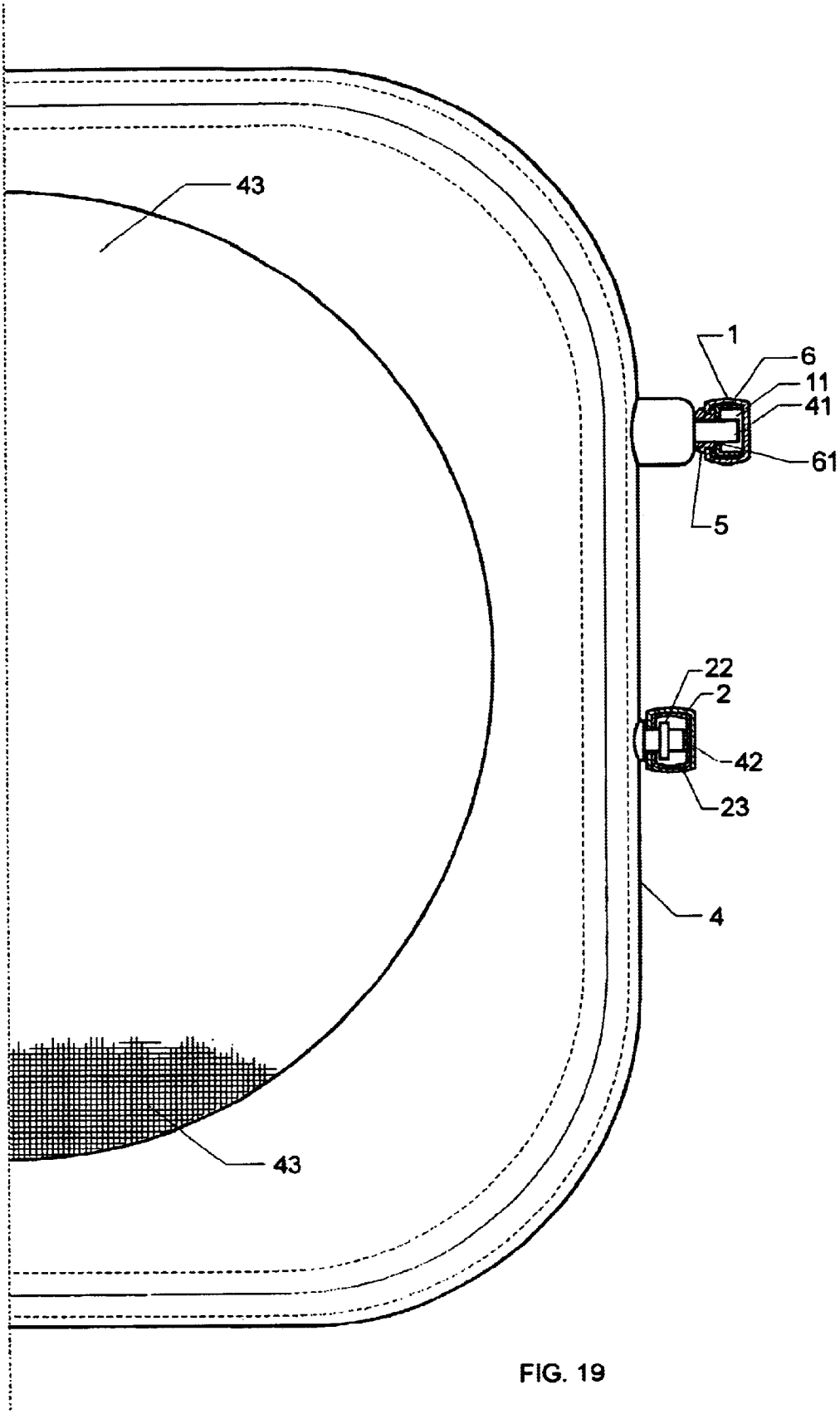
FIG. 19 shows the connection between the seat, the front chair leg, and the rear chair leg.
Figure 20:
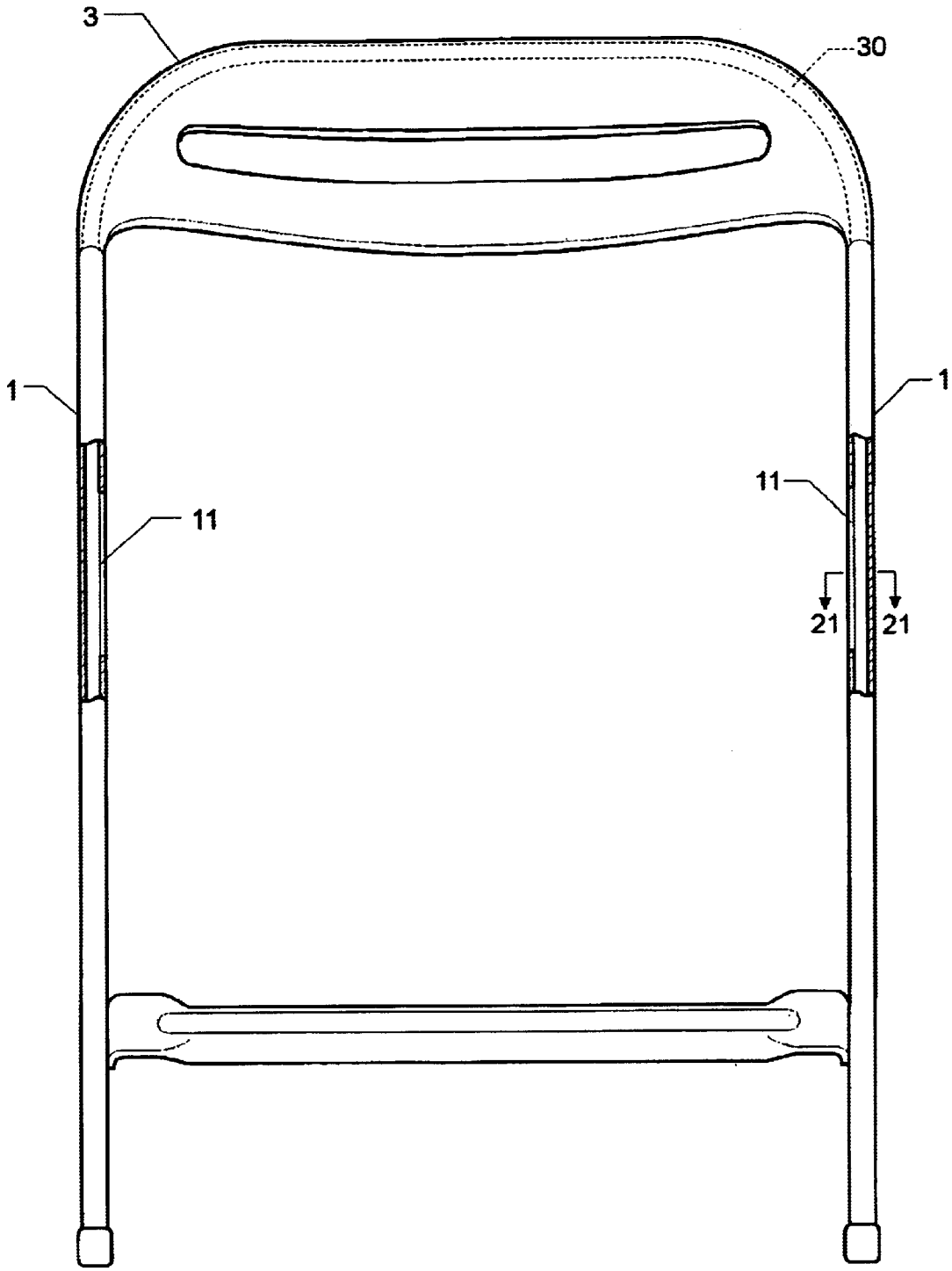
FIG. 20 is a front view of the front chair leg.
Figure 21:
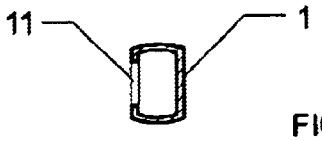
FIG. 21 is a sectional view taken along line 21—21 of FIG. 20.

The slide magazine 6 (as shown in FIGS. 16 to 18) is up and down slidably disposed in the front chair leg 1. The main body of the slide magazine 6 has a U-shaped cross-section. When assembled, the opening faces the interior of the front chair leg 1. The bottom end of the slide magazine 6 is formed with a fitting hole 61 for the rear pivot shaft 411 of the seat 4 to fit therethrough and locate therein. The upper end of the slide magazine is formed with a C-shaped hooking notch 62. An operator can use an iron wire or other elongated tool to hook the hooking notch 62 so as to insert the slide magazine 6 into the front chair leg 1 for assembling with the rear pivot shaft 41 of the seat 4. The tool can be easily detached from the hooking notch 62. FIG. 19 shows the assembly of the rear pivot shaft 41 of the seat 4 and the slide rail washer 5 and slide magazine 6 of the slide rail 11 of the front chair leg 1. When the chair is unfolded, the seat 4 is horizontally positioned and the slide rail 11 is covered by the internal slide magazine 6.

The rear chair leg 2 is pivotally connected with the front chair leg 1 at pivot point A. The inner wall of top end of the rear chair leg 2 is formed with a pivot hole 21 for the front pivot shaft 42 of the seat 4 to fit therethrough. The pivot bole only passes through the inner wall of the rear chair leg 2. The front pivot shaft 42 of the seat 4 extends into the tube of the rear chair leg 2 and is located therein by a retainer ring 22 (as shown in FIG. 19). Therefore, the pivot point is not exposed to outer side. A cap 23 is fitted with top end of the rear chair leg 2 to seal the same as shown in FIG. 1.

Referring to FIGS. 1 to 9 and 19, the periphery of the seat 4 encloses therein a metal tube 40. When formed, the mesh seat face 43 is at the same time fixed. Accordingly, the seat 4 encloses therein the metal tube 40 and the has the mesh seat face 43. The rear pivot shaft 41 for assembling with the front chair leg 1 and the front pivot shaft 42 for assembling with the rear chair leg 2 are respectively disposed on lateral sides of the seat 4. The front and rear pivot shafts 42, 41 respectively pass through the enclosed metal tube 40 and are integrally combined when molding the seat 4. The outward extending length of the rear pivot shaft 41 is longer than the length of the front pivot shaft 42. The rear pivot shaft 41 is inserted in the fitting hole 61 of the slide magazine 6 in the slide rail 11 of the front chair leg 1. The front pivot shaft 42 is passed through the inner wall of top end of the rear chair leg 12 and located therein by the C-shaped retainer ring 22.

Referring to FIG. 1, the present invention has light weight so that it can be easily operated. When the seat 4 is horizontally positioned, the rear pivot shaft 41 of the seat 4 makes the slide magazine 6 in the front chair leg 1 move downward. When the rear pivot shaft 41 is positioned at the bottom end of the slide rail 11, the slide rail opening is covered by the internal slide magazine 6.

According to the above arrangement, the present invention has the following advantages:

1. The slide rail enables a user to smoothly operate the foldable chair. The chair is light and can be folded into a plane state without clamping the user's hand. The slide rail opening is automatically covered so that when the seat is positioned horizontally, the slide rail is not exposed to outer side.
2. The back and the seat both enclose therein metal tubes. In addition, the seat is integrally formed with mesh seat face with good ventilation effect.
3. The front and rear pivot shafts of the seat for pivotally connecting with the front and rear chair legs are passed through and fixed in the internal metal tubes so that the foldable chair is firmer and able to bear greater load.
4. The pivoted sections of the seat and the front and rear chair legs are all hidden.
5. Only the pivot point A of the front and rear chair legs is exposed.
6. When placing the seat horizontally for use, it is safe to press down the seat face from front side or rear side thereof. The pressure is even so that the seat will not be tilted down to cause danger.

The above embodiment is only used to illustrate the present invention, not intended to limit the scope thereof. Many modifications of the above embodiment can be made without departing from the spirit of the present invention.

What is claimed is:

1. A folding chair comprising:

a front chair leg, a rear chair leg, a back, and a seat, wherein;

said front chair leg is pivotally connected to said rear chair leg at a pivot point, an elongated slide is formed in an inner side of said front chair leg above said pivot point, a slide washer is laid on the opening of the slide, a back of said slide washer being inserted in an upper end of said front chair leg, said slide washer receiving therein a metal tube, two sides of said metal tube having downward extending insertion legs that are received in top openings of two sides of said front chair leg, a slide magazine is movably disposed in said slide of said front chair leg, a main body of said slide magazine having a U-shaped cross-section, said slide magazine having an opening facing an interior of said front chair leg, a bottom end of said slide magazine including a fitting hole to receive a rear pivot shaft of said seat, an upper end of the slide magazine including a C-shaped hooking notch, said rear chair leg is pivotally connected to said front chair leg at said pivot point, an inner wall of said rear chair leg including a pivot hole at a top end thereof to receive a front pivot shaft of said seat, said pivot hole extends through only said inner wall of said rear chair leg, said front pivot shaft of said seat extending into said rear chair leg and being secured therein by a retainer ring, a cap being fitted on a top end of said rear chair leg, and a periphery of said seat encloses a metal tube with a mesh seat face being fixed therein, said rear pivot shaft that is received in said front chair leg and said front pivot shaft that is received in said rear chair leg being disposed on lateral sides of said seat, said front and rear pivot shafts passing through said metal tube and being integral members of said seat, an outward extending length of said rear pivot shaft being longer than a length of said front pivot shaft, said rear pivot shaft being inserted in said fitting hole of said slide magazine in said slide of said front chair leg, said front pivot shaft passing through said inner wall of said rear chair leg and secured therein by said retainer ring.

2. A folding chair comprising:

a front chair leg, a rear chair leg, a back, and a seat, wherein;

said front chair leg is pivotally connected to said rear chair leg at a pivot point, an inner side of said front chair leg including an elongated slide rail above said pivot point, a slide washer being inserted into an opening of said slide, a slide magazine being movably disposed in said slide of said front chair leg, a main body of said slide magazine having a U-shaped cross-section, a bottom end of said slide magazine including a fitting hole to receive a rear pivot shaft of said seat, and an inner wall of said rear chair leg includes a pivot hole at a top end thereof to receive a front pivot shaft of said seat, said pivot hole extending through only said inner wall of said rear chair leg, a cap being fitted on a top end of said rear chair leg.

3. The folding chair as claimed in claim 1, wherein:

said front and rear chair legs are tubular bodies made of metal.

4. The folding chair as claimed in claim 1, wherein:

said slide washer has a substantially I-shaped cross-section, two sides of said slide washer being curved slightly outward.

5. The folding chair as claimed in claim 2, wherein:

said front and rear chair legs are tubular bodies made of metal.

6. The folding chair as claimed in claim 2, wherein:

said slide washer has a substantially I-shaped cross-section, two sides of said slide washer being curved slightly outward.

* * * * *